US005299717A

United States Patent [19]

Geier

[11] Patent Number: 5,299,717

[45] Date of Patent: Apr. 5, 1994

[54] MANUAL SPRAYER DEVICES COMPRISING A TRIGGER LEVER

[75] Inventor: Adalberto Geier, Villazzano, Italy

[73] Assignee: Coster Tecnologie Speciali S.p.A., Italy

[21] Appl. No.: 915,412

[22] Filed: Jul. 14, 1992

[30] Foreign Application Priority Data

Aug. 30, 1991 [IT] Italy ..... MI91 A 002331

[51] Int. Cl.[5] ..... B05B 11/02

[52] U.S. Cl. ..... 222/340; 222/383; 239/333

[58] Field of Search ..... 222/383, 340, 321, 384; 239/333, 493

[56] References Cited

U.S. PATENT DOCUMENTS

| | | | |
|---|---|---|---|
| 3,768,734 | 10/1973 | Anderson, Jr. | 239/333 |
| 4,153,203 | 5/1979 | Tada | 239/333 |
| 4,191,313 | 3/1980 | Blake et al. | 222/383 X |
| 4,624,413 | 11/1986 | Corsette | 239/333 |
| 4,728,009 | 3/1988 | Schmidt | 239/333 |

FOREIGN PATENT DOCUMENTS 145864 6/1920 United Kingdom .

*Primary Examiner*—Sherman Basinger
*Attorney, Agent, or Firm*—Steinberg & Raskin

[57] ABSTRACT

The improvements relate to the connections between the trigger lever (21) and the body (1) of the sprayer device, and to the rod (18) of the pumping piston (17). The rod (18) is coupled to the trigger lever (21), which is snap-inserted, as a fork arrangement, into the body (1) of the sprayer device.

14 Claims, 3 Drawing Sheets

MANUAL SPRAYER DEVICES COMPRISING A TRIGGER LEVER

BACKGROUND OF THE INVENTION

This invention relates to improvements in manual sprayer devices comprising a body fixable to a container containing the liquid to be sprayed, a cylinder in said body, a piston movable within said cylinder, and a trigger-type operating lever which is rotatably mounted in said body and connected to said piston in such a manner as to move it in the two directions and on which there act elastic return means which react against the body and are out of contact with the liquid to be sprayed.

A sprayer device of this type is known for example from U.S. Pat. No. 4,153,203 (TADA). In this known device the structure of the trigger lever is particularly complicated and the piston also has a certain constructional complexity. In this respect, the trigger lever upperly comprises two outwardly projecting lugs for its hinging to the body (this requiring the presence of counteracting means between the two lugs to prevent their accidental escape from the body seats in which they are held), two external projections in a middle position for connecting the return spring, an inner shaped thrust surface and grooves or seats for connecting the piston to enable movement to be transmitted to it in the two directions. The piston itself is formed from two parts, one of which comprises transverse pins for connecting the trigger lever and a tang for deforming a gasket.

OBJECTS AND SUMMARY OF THE INVENTION

The main object of the present invention is to substantially simplify the structure of the trigger lever by using special original connections between it and the body and piston.

A further object of the present invention is to provide improvements by which simpler automation of the assembly of the trigger lever within the body and its bidirectional connection to the piston is achieved.

A further object of the present invention is to improve sprayer devices of the known art such as to make them more economical to produce, but without affecting their functionality or their life.

These and further objects which will be more apparent from the ensuing description are attained by improvements characterised essentially in that the trigger lever comprises at its upper forked end two heads to be inserted into apertures within the body which are bounded partly by elastically deformable lugs opposing the escape of the heads, and further comprises in an intermediate position a toothed hole for engagement with the piston or its prolongation.

BRIEF DESCRIPTION OF THE DRAWING

The invention will be more apparent from the detailed description of a preferred embodiment thereof given hereinafter by way of non-limiting example with reference to the accompanying drawings, in which.

DETAILED DESCRIPTION OF THE INVENTION

Figure 1:
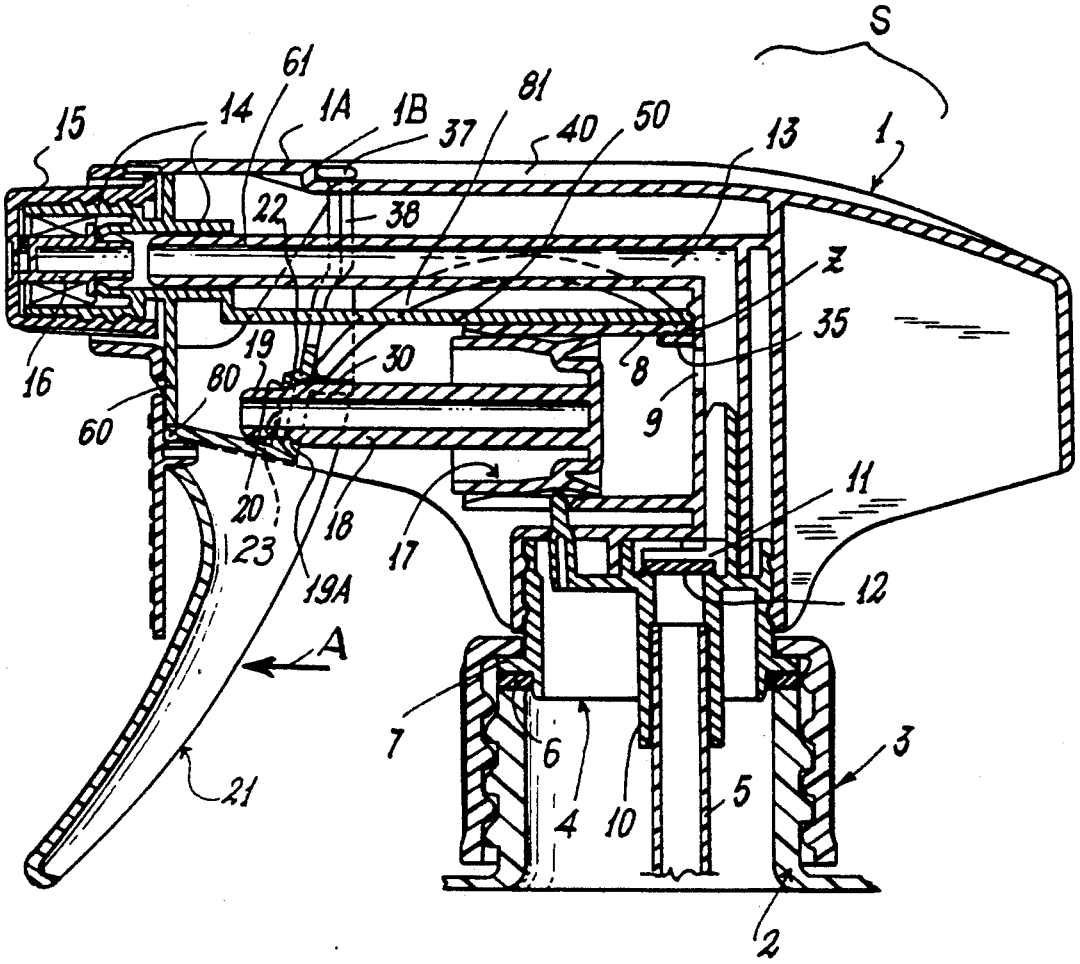
FIG. 1 is a longitudinal middle section through a sprayer device provided with the improvements of the invention.
Figure 2:
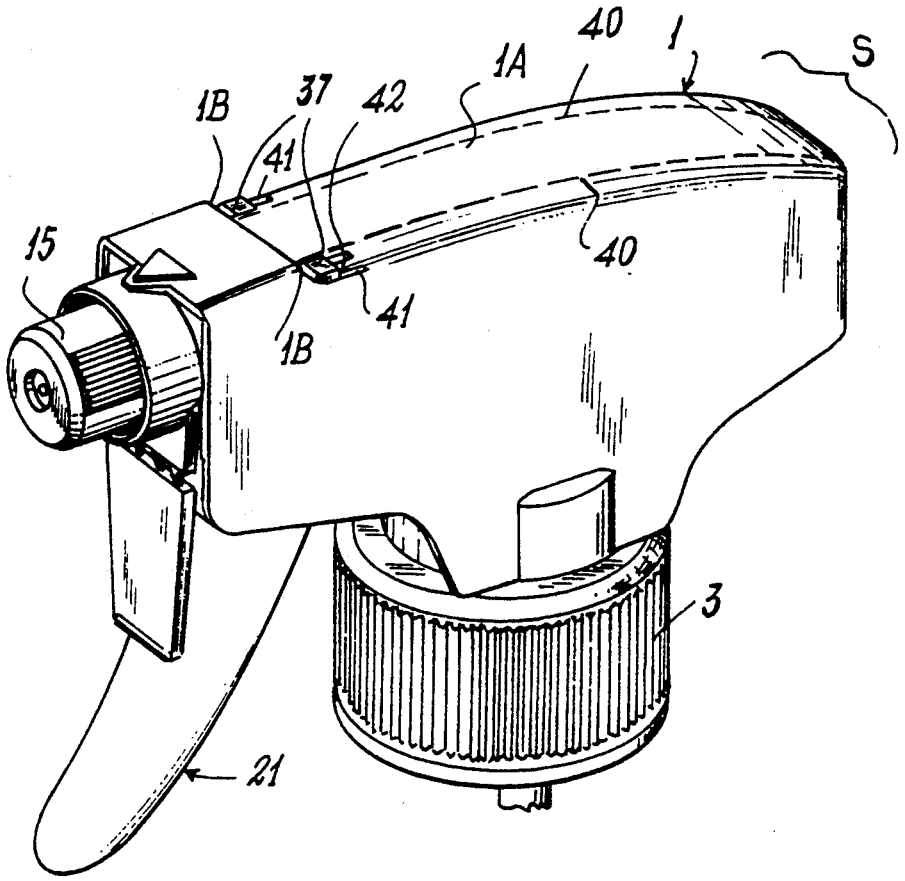
FIG. 2 is a perspective view of the sprayer device.

With reference to the figures, the manual sprayer device S shown therein comprises a body 1 to be connected to a container 2 containing the liquid to be dispensed. The connection is made via an axially holed screw cap 3 to be screwed onto the threaded neck of the container, an insert 4 force-fitted into the body 1 and carrying in a tubular appendix 10 a conventional dip tube 5 and traversing said cap 3, and an annular gasket 6 which is clamped against the top of the neck of the container 2 by an outer flange 7 of the insert 4 when the cap 3 is screwed onto said neck.

A cylinder 8 is provided in the body 1. This cylinder has an aperture 9 which communicates with a channel through which the liquid to be dispensed moves. This channel is composed of a first portion represented by the dip tube 5 and the tubular appendix 10 which holds it, a second portion formed by a chamber 11 defined by the insert 4 and body 1 and containing with a certain freedom for movement a disc 12 acting as a suction valve, and a third portion indicated by 13 which extends into the body 1 and into a threaded tubular appendix 14 which together with a nozzle screwed to it defines a chamber containing a member 16 acting as a delivery valve and mixing head. The member 16 can be of any known type and will not be further described as it does not concern the present invention.

A piston 17 is movably mounted within the cylinder 8 and comprises a hollow prolongation or rod 18 which terminates with a portion of lesser cross-section via a step, or abutment 19A. This terminal portion 19 extends through an intermediate aperture 20 in a trigger lever indicated overall by 21 and rotatably connected to the body 1 in the manner described hereinafter in detail.

Figure 3:
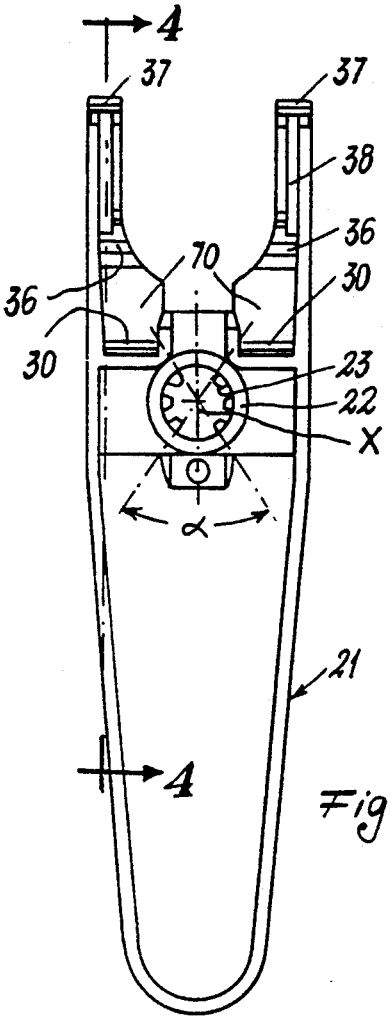
FIG. 3 is a view of the trigger lever taken in the direction of the arrow A of FIG. 1.

The intermediate aperture 20 (see also FIG. 3) is provided at the end of an approximately frusto-conical axially hollow projection 22 on the trigger lever 21. The aperture 20 comprises two sets of saw-teeth 23, the less inclined face of which faces the interior of the projection 22. The two sets of teeth are symmetrical about the axis of symmetry X of the trigger lever 21 and are lacking along two opposing arcs of the aperture 20 symmetrical about the axis X and extending angularly (see angle $\alpha$) through about 30°–40°.

The two sets of teeth enable the terminal portion 19 of the rod to be inserted through the aperture 20 but prevent it from being extracted because any attempt at extraction causes the teeth to bite into the rod material, the chosen material being softer than the lever material. This achieves a reliable unidirectional connection between the lever and piston.

The step 19A separating the terminal portion 19 from the greater cross-section portion of the rod 18 of the piston 17 lies within the hollow frusto-conical projection 22. The step at least partly lies against the inner face of the projection.

The described teeth enable movement to be transmitted in one direction by the trigger lever to the piston (in the case of FIG. 1, towards the left of the rod) because the teeth 23 bite into the material of the rod 18 (the prolongation of the piston 17) to thereby establish engagement between the teeth 23 and the rod 18. Thus, as the trigger lever moves to the left (in the direction of arrow A as shown in FIG. 1), the teeth 23 move with the trigger lever, and as a result of the biting engagement between the teeth 23 and the rod 18, the piston is also moved in the same direction to thereby provide a unidirectional engagement. In addition, movement in the other direction is transmitted by virtue of the contact between the step 19A and the inner face of the frusto-conical projection 22. Thus, as the trigger lever and associated teeth move to the right (as shown in FIG. 1), the teeth disengage from the biting engagement with the rod 18 whereupon the projection or reaction surface 22 engages the step 19A of the piston 17, so that the piston 17 is also moved in the same direction to thereby provide a unidirectional engagement in an opposite direction.

The trigger lever also comprises two seats or recesses 30 arranged symmetrically about the axis X in proximity to the top part of the hollow frusto-conical projection 22. The recesses 30 contain the ends of two arched springs 81 (only one of which is visible in FIG. 1) of plastics construction, as is the rest of the device, their other ends resting against supports inside the body 1.

The upper end of the trigger lever 21 is fork-shaped (FIG. 3), at the top ends of the relative arms 36 there being provided transverse heads 37 of substantially rectangular contour. A longitudinal rib 38 extends along the rear of the arms 36 and terminates at the head, where it comprises a recess 39.

Figure 4:
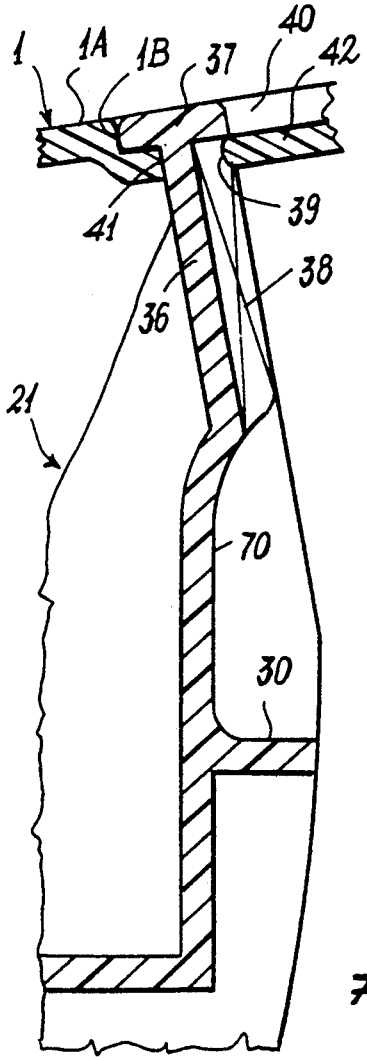
FIG. 4 is a detailed sectional view showing the connection between the trigger lever and the body, the section through the lever being taken on the line B—B of FIG. 3.

At the edges on the top 1A of the body 1 there are provided two parallel grooves 40 extending from a step 1B. Immediately after the step 1B, each groove 40 comprises an aperture 41 into which there projects a part of a tongue 42 forming part of the body 1. The trigger lever 21 is fitted into the body 1 by inserting the heads 37 through said apertures 41 utilizing the flexibility of the tongues 42 or elastically deformable lugs, which then engage in the recess 39 in the ribs 38. The heads 37 are positioned (FIG. 4) on part of the contours of the aperture 41 and indirectly on the tongue 42. In this manner a hinge is formed, about which the trigger lever 21 can rotate.

It should be noted that because of the particular arrangement of the teeth 23, the shape of the cavity in the projection 22 containing the step 19A of the rod 18, and the particular hinge connection between the trigger lever 21 and the body 1, rectilinear movements can be transmitted to the piston 17 by the trigger lever 21 without the linkage formed in this manner offering any abnormal resistance due for example to jamming between the parts.

At that end Z thereof distant from the trigger lever 21, the two arched springs 81, which form the subject of a simultaneous patent application in the name of the present applicant, are joined together and to the end of an intermediate strip 50 which at its other end carries the threaded appendix 14 (already mentioned) and a front wall 60 for frontwardly closing the body 1. This assembly is fitted into the body 1 by forcing the smaller part of the appendix 14 over the tubular duct 61, which defines the last part of the portion 13 of the liquid path and which forms part of the body 1, until the ends Z of the springs 81 reach the supports 35 on the body 1.

The piston 17 is then inserted into the cylinder 8 until it reaches its end of travel (to the right in FIG. 1). An adequate portion of the rod 18 remains outside the open end of the cylinder 8. The trigger lever 21 is then inserted into the body 1 as already described. On doing this the free ends of the two springs move into the seats 30 in the trigger lever 21 by sliding along guide surfaces 70 provided on the lever. The trigger lever is then rotated to the right (with reference to FIG. 1) as far as possible. By this means the narrow end 19 of the rod 18 passes through the aperture 20 in the trigger lever 21 and the step 19A of the rod 18 becomes positioned against the inner contour of the projection 22 on the lever. On releasing this latter, the springs return the lever 21 and piston 17 into their rest position in which a projecting part 80 of the lever halts against the lower end of the wall 60.

I claim:

1. Improvements in manual sprayer devices comprising a body (1) fixable to a container (2), a cylinder (8) in said body (1), a piston (17) movable within said cylinder (8), and a trigger-type operating lever (21) which is rotatably mounted in said body (1) and connected to said piston (17) in such a manner as to move it in two directions and on which there act elastic return means (81) which react against the body (1) and are out of contact with the liquid to be sprayed, characterised in that the trigger lever (21) comprises a forked end with two heads (37) arranged to pass through apertures (41) within the body which are bounded partly by elastically deformable lugs (42), and further comprises in an intermediate position a toothed aperture (20, 23) for unidirectional engagement with a narrowed terminal part (19) of the piston (17), and a reaction surface (22) cooperating with an abutment (19A) on the piston (17) for unidirectional engagement in the opposite direction to the preceding engagement.

2. Improvements as claimed in claim 1, characterised in that the reaction surface (22) of the trigger lever (21) is represented by the inner face of a hollow projection on the lever, which communicates with and is coaxial to the toothed aperture (20, 23), the abutment being represented by the transition region (19A) between the narrowed part (19) and a wider part of the piston.

3. Improvements as claimed in claim 1, characterised in that the toothed aperture (20, 23) comprises two sets (23) of teeth, these sets being symmetrically positioned about the longitudinal axis (X) of the trigger lever (21) and separated by untoothed regions (a) through which said axis (X) passes centrally.

4. Improvements as claimed in claim 1, characterised in that the apertures (41) are provided in the top of the body (1) in correspondence with lateral grooves (40) therein.

5. Improvements as claimed in claim 1, characterised in that the trigger lever (21) comprises seats (30) for supporting the ends of the elastic return means (81), said seats being in proximity to the toothed aperture (20, 23).

6. Improvements as claimed in claim 1, wherein said piston further comprises a rod connected to said narrow terminal part.

7. Improvements as claimed in claim 6, wherein said rod has a larger cross section than said narrow terminal part such that said abutment is defined between said narrow terminal part and said rod.

8. A manual sprayer device for spraying fluid from a container, comprising a body structured and arranged to be attached to a fluid-containing container, said body including apertures arranged in an upper surface thereof and bounded by elastically deformable lugs, a cylinder arranged in said body for delivering fluid to an outlet of said device, a piston movable within said cylinder, a step being defined at an end portion of said piston, a trigger-type operating lever rotatably mounted in said body and connected to said end portion of said piston, said trigger lever being movable in a first and second direction to spray fluid, elastic return means for moving said trigger lever in said second direction, said trigger lever having a forked end with a pair of heads, said heads being arranged to pass through said apertures in said body, said trigger lever further comprising an additional aperture through which said end portion of said piston passes, said additional aperture having teeth engaging with said end portion and a reaction surface engaging with said step, such that movement of said trigger lever in the first direction causes said reaction surface to move said step of said piston in the first direction and movement of said trigger lever in the second direction causes said teeth to penetrate and move said end portion of said piston in the second direction.

9. The device of claim 8, wherein said end portion of said piston contacts an inner face of said additional aperture, said piston further comprising a rod having a larger cross section than said end portion such that said step is defined between said rod and said end portion.

10. The device of claim 8, wherein said tooth aperture comprises two sets of teeth arranged symmetrically about a longitudinal axis of said trigger lever and separated by untoothed regions through which the longitudinal axis passes.

11. The device of claim 8, wherein said apertures are arranged in a top portion of said body and are connected to lateral grooves arranged in said body.

12. The device of claim 8, wherein said trigger lever further comprises seats for supporting ends of said elastic return means, said seats being arranged in proximity to said additional aperture.

13. The device of claim 8, wherein said elastic return means comprise arched springs, a first end of said arched springs being supported in seats arranged on said trigger lever and a second end of said arched springs being supported on supports arranged in said body.

14. The device of claim 8, wherein said end portion comprises a material which is softer than the material of said teeth such that said teeth engage with and penetrate into said end portion when said trigger lever is moved in the second direction.

* * * * *